United States Patent [19]

Verhulst

[11] Patent Number: 4,965,562

[45] Date of Patent: Oct. 23, 1990

[54] ELECTROSCOPIC DISPLAY DEVICE

[75] Inventor: Antonius G. H. Verhulst, Eindhoven, Netherlands

[73] Assignee: U.S. Philips Corporation, New York, N.Y.

[21] Appl. No.: 191,297

[22] Filed: May 6, 1988

[30] Foreign Application Priority Data

May 13, 1987 [NL] Netherlands ..... 8701138

[51] Int. Cl.[5] ..... G09G 3/00

[52] U.S. Cl. ..... 340/783; 350/339 R; 350/345

[58] Field of Search ..... 340/763, 764, 783, 788; 350/269, 339 F, 345, 339 R; 313/468, 487; 156/644

[56] References Cited

U.S. PATENT DOCUMENTS

| | | | |
|---|---|---|---|
| 4,208,611 | 6/1980 | Watanabe et al. | 313/487 |
| 4,309,242 | 1/1982 | Te Velde | 156/644 |
| 4,420,896 | 12/1983 | Castleberry | 340/763 |
| 4,420,897 | 12/1983 | Castleberry | 340/763 |
| 4,520,357 | 5/1985 | Castleberry et al. | 340/783 |
| 4,678,285 | 7/1987 | Ohta et al. | 350/339 F |
| 4,723,171 | 2/1988 | Kuijk et al. | 340/788 |
| 4,723,834 | 2/1988 | Van de Venne et al. | 340/763 |
| 4,725,832 | 2/1988 | Lorteije et al. | 340/783 |
| 4,729,636 | 3/1988 | Te Velde et al. | 340/763 |
| 4,740,785 | 4/1988 | Stroomer et al. | 340/783 |
| 4,772,885 | 9/1988 | Uehara et al. | 350/345 |
| 4,822,144 | 4/1989 | Vriens | 350/339 F |

*Primary Examiner*—Alvin E. Oberley
*Assistant Examiner*—Richard Hjerpe
*Attorney, Agent, or Firm*—Paul R. Miller

[57] ABSTRACT

Light losses occurring in an electroscopic display device in which UV radiation (9, 10) is converted into visible light (14, 15, 17) are partly annihilated by making the movable electrodes (7) and the fixed electrodes (4) reflective. The electroscopic display device comprises first and second radiation-transparent supporting plates (2, 3), wherein a plurality of display elements are disposed between the supporting plates (2, 3). A luminescent material (12) is disposed on one of the first and second supporting plates (2, 3) at a viewing side, wherein the luminescent material (12) is disposed between the first and second supporting plates (2, 3) adjacent to and facing the electrodes (4, 7) such that the electrodes (4, 7) reflect radiation emitted by the luminescent material (12) to increase the passage of radiation through the viewing side of the display. An extra advantage is that a diffuse light source can then be used.

9 Claims, 1 Drawing Sheet

ELECTROSCOPIC DISPLAY DEVICE

Figure 1:
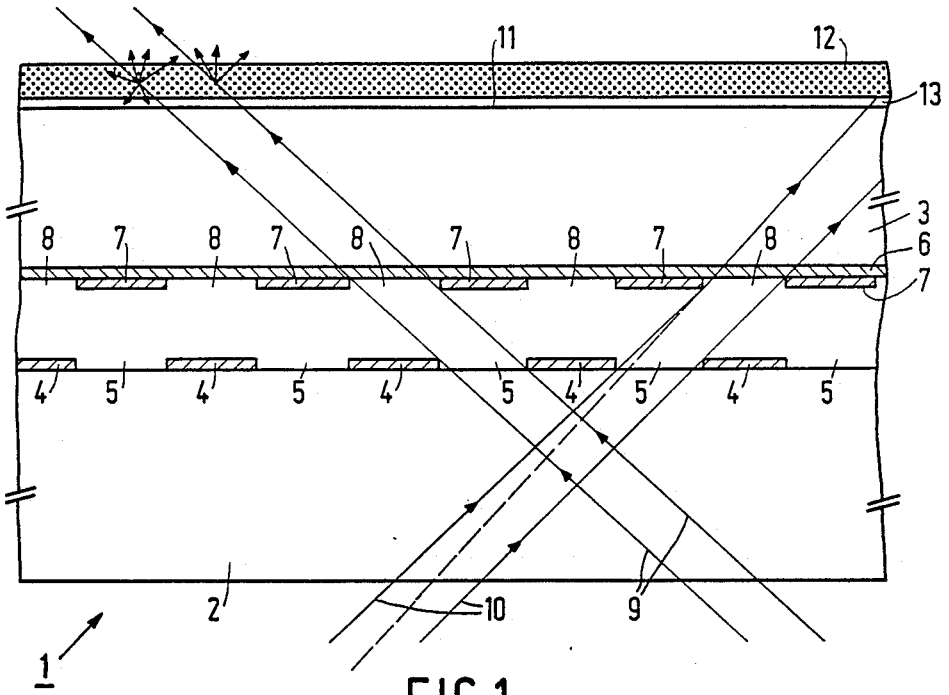
FIG.1 PRIOR ART

The invention relates to a display device comprising a first and a second radiation-transparent supporting plate, a plurality of display elements each having at least one fixed electrode and one electrode which is movable with respect to the fixed electrode by means of electrostatic forces and which has two end positions determined by abutment faces, said electrode being separated from the fixed electrode by means of an electrically insulating layer and being provided with a pattern of radiation-transparent apertures, the device being provided at the area of the fixed electrode with a pattern of areas which are not transparent to radiation, which pattern is substantially identical to the pattern of radiation-transparent areas in the movable electrode, the display element passing substantially no radiation when the two patterns are substantially co-planar.

A device of this type is described in United States Pat. No. 4,309,242. FIG. 10 of this Patent describes how such a device is driven in the transmission mode i.e., with transmitted light. As is apparent from this Figure, use is made of directed light radiation. On the one hand this results in a limitation with respect to the viewing angle at which the picture generated in the device can be observed, while on the other hand the use of such a light source takes extra space in comparison with, for example, a diffuse light source. & It is an object of the invention to provide a picture display device of the type described in the opening paragraph in which the viewing angle has substantially no influence on the picture display, whilst also a more compact light source can be used. To this end a device according to the invention is characterized in that the device is driven in the transmission mode and the supporting plate on the viewing side is provided with luminescent material on its side facing the electrodes and in that a radiation source is used which is suitable for emitting radiation of a sufficiently short wavelength to excite the luminescent material, whilst at & least one of the two electrodes on its side facing the luminescent material is reflective to the radiation emitted by this material. Both the fixed and the movable electrode are preferably made reflective to this radiation emitted by the luminescent material.

Since the picture on the viewing side is generated in luminescent material (for example, blue, green and red phosphors), the intensity of the emitted light in all directions is substantially equal. The luminescent material is, for example, excited by UV light which realises the conversion to visible light.

However, during this conversion a large portion of the amount of light generated in the phosphors is lost. In fact, the conversion is effected within a very thin layer (approximately 2 to 3 microns) on the side of the incident ultraviolet radiation. Since the generated visible light is emitted in all directions and is also scattered by the phosphors, a large part thereof (approximately 60 to 70% leaves the phosphor layer on the side of the UV source. This of course leads to a lower brightness, but moreover a part of the light generated in the phosphors may be partly back& scattered via reflection from various surfaces and then at an unacceptably large spatial angle or at undesired locations. All this leads to a loss of resolution and a reduced contrast.

In the non-prepublished Netherlands Patent Application No. 8,603,298 in the name of the Applicant corresponding to U.S. Pat. No. 4,822,144 the use of an interference filter is proposed which substantially completely reflects light emitted in the direction of the radiation source. Such a solution is not strictly necessary in electroscopic display devices according to the invention, & because a part of the light emitted by the phosphors in the direction of the radiation source is reflected by the movable electrode.

An additional advantage, which is due to the small distance between the two supporting plates, is that a diffuse radiation source can be used, as will hereinafter be described in greater detail.

Figure 2:
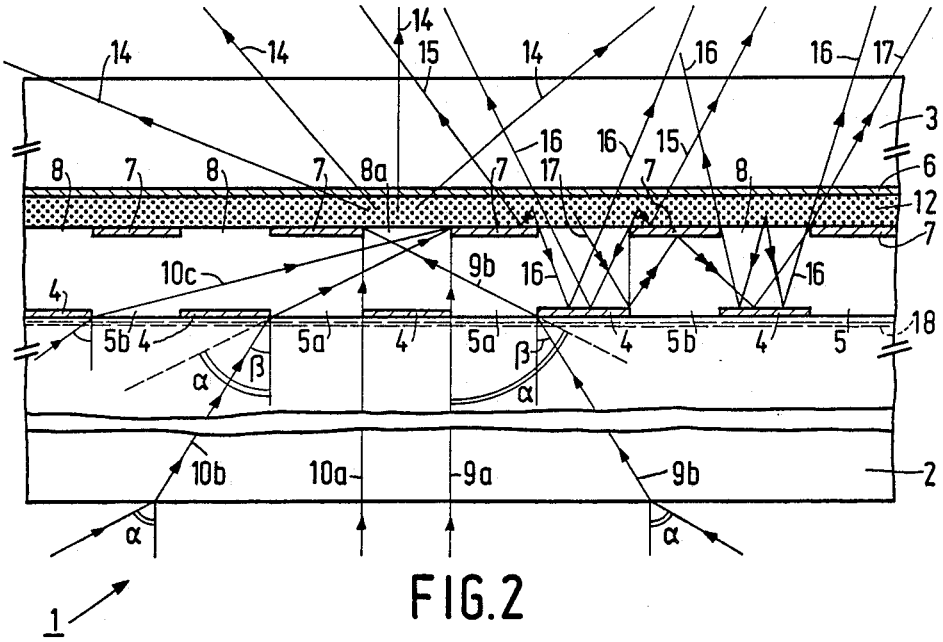

The invention will now be described in greater detail by way of example with reference to the accompanying drawing in which FIG. 1 shows diagrammatically a device as proposed in the non-prepublished Netherlands Patent Application No. 8,603,298 in the name of the Applicant and FIG. 2 shows diagrammatically a device according to the invention.

The Figures are diagrammatical and not to scale. Corresponding elements are generally denoted by the same reference numerals.

The device of FIG. 1 shows diagrammatically a part of an electroscopic display device according to U.S. Pat. No. 4,309,242 in which only one pixel is shown in its light-transmissive state.

The display device 1 has a first supporting plate 2, in this example of quartz or another UV-transmitting material and a second supporting plate 3 of, for example, glass. A fixed electrode 4 having a pattern of apertures 5 which are transparent to radiation is present on the first supporting plate 2. A transparent counter electrode 6 of, for example, indium tin oxide is present on the second supporting plate 3. An electrode 7 is freely movable between the two supporting plates 2, 3. This electrode 7 has apertures 8 which are transparent to radiation and is movable between the two 0 supporting plates by means of electrostatic forces, while, for example, resilient means not shown are present in order to provide the movable electrode with electrical voltages and to bring it to a balanced position.

The end positions of the movable electrode are & separated from the electrodes 4, 6 by electrically insulating layers which are not shown. For a more detailed description of the operation and the arrangement of such a display device reference is made to said U.S. Pat. No. 4,309,242.

In the radiation-transmissive state as is shown in FIG. 1 the radiation beams 9, 10 must pass both the apertures 5 and 8 in the fixed electrode 4 and the movable electrode 7, respectively, when using visible light. For the sake of clarity refraction and reflection have not been taken into account in the drawing of the radiation path. Without special measures these beams leave the front surface 11 of the display device at an angle which is approximately 40–50° dependent on the geometry of the electrodes 4, 7 and the distance between the supporting plates 2, 3. Consequently the viewing angle of such a display device is very limited.

As described in the non-prepublished Netherlands Patent Application No. 8,603,298 in the name of the Applicant the & latter drawback can be considerably mitigated by using UV radiation for the radiation beams 9, 10 and by coating the surface 11 with a phosphor layer 12 irradiating light generated in the layer 12 to all sides. Since colour filters are no longer required in colour picture display devices, the brightness also increases. Possible losses due to backscattering of light generated in the phosphor layer 12 may be largely compensated for by using an interference filter 13. Directed radiation beams 9, 10 however, remain necessary due to the relatively large distance between the & phosphor layer 12 and the actual switching elements (located between the electrodes 6 and 4).

In a device according to the invention, as shown in FIG. 2, the luminescent layer, in this example a phosphor layer 12, is present on the other side of the supporting plate 3. The counter electrode 6 is present between this supporting plate 3 and the phosphor layer 12. In the drawing of the radiation path of the UV radiation beams 9, 10 refraction of the radiation has been taken into account. The Figure shows that within the aperture 8*a* not only the beams 9*a*, 10*a* which are substantially perpendicularly incident may hit the phosphor layer 12, but also the beams 9*b*, 10*b* which are incident at an angle $\alpha$ with respect to the normal and the beams with angles of incidence therebetween.

The geometry of the electrodes and the distance of the supporting plates determine the angle $\alpha$ and hence the angle $\beta$ with which the UV beam 9, 10 is incident on the interface between the quartz and the electro-optical medium which is air in this example. They may be chosen to be such that $\beta$ is at least equal to the so-called critical angle. In that case the beams which are incident on the phosphor layer 12 within the aperture 8*a* will substantially only originate from the apertures 5*a* in the fixed electrode 4. For a slightly different choice contributions are also possible from radiation through the apertures 5*b* (beams 10*c*) but they will be considerably smaller because then the conditions for total reflection from the quartz glass-air surface is & satisfied sooner.

It will be evident from the foregoing that UV radiation may be incident at angles varying to at least $\alpha°$ with respect to the normal, which provides the possibility of using a diffuse UV source. The latter is advantageous because they can be manufactured more easily in practice and may have a flat shape so that the total thickness of the device is reduced.

The ultraviolet radiation emitted by the UV source realises conversion to visible light 14 in the phosphor layer & 12 (for example, to the primary colours red, green, blue) which is passed by the second supporting plate 3 of, for example, glass at a large angle range and which constitutes a (colour) picture. A part of this light is, however, lost because the generated light is emitted to all directions and is scattered by the phosphors.

Since according to the invention the movable electrode is reflective on its side facing the phosphor layer 12, a part of the backscattered light (illustrated in this example by means of light beams 15) is reflected by this & electrode so that it still contributes to the light output.

Light beams which are scattered in the apertures 8 of the movable electrode in the direction of the fixed electrode are reflected by these electrodes because in this embodiment the fixed electrodes are also reflective. In this manner a part of the backscattered light (illustrated in this example by means of light beams 16) is reflected to the front & surface 11 of the display device. In the latter case the reflective beam does not necessarily have to return via the same aperture 8, but it may alternatively return through apertures 8 located in proximity, provided that the movable electrodes 7 are reflective on both sides. In the relevant example this is illustrated by means of light beam 17.

Various choices are possible for the phosphors. When using a radiation source based on the 254 nm Hg resonance line, the following combination is very satisfactory:

Ba $Mg_2$ $Al_{16}$ $O_{27}$:Eu as a blue phosphor (maximum emission at 450 nm);

Ce Mg $Al_{11}$ $O_{19}$:Tb as a green phosphor (maximum emission at 545 nm);

$Y_2$ $O_3$:Eu as a red phosphor (maximum emission at 612 nm).

The associated emission wavelengths are satisfactorily suitable for the maximum sensitivity of each of the three colour receptors of the eye; this provides the possibility of an eminent colour rendition. When using a & radiation source mainly with long-wave UV radiation, for example, a high-pressure mercury lamp, very suitable materials are, for example, Zn S:Ag (blue), (Zn, Cd) S:Cu, Al (green) and $Y_2O_2$ S:Eu (red).

The movable electrodes may be secured to one of the supporting plates, for example, by means of resilient elements which are provided on the circumference of the movable electrodes. In this case the resilient force ensures that in the rest state the movable electrodes are in such a position that the device is transparent to light. It is & alternatively possible to effect switching completely electrostatically. In that case the device has an extra transparent electrode shown diagrammatically. All this is described in greater detail in Netherlands Patent Application No. 8600697.

In the foregoing description it has been assumed that the electrodes 4 are fixed and the electrodes 7 are & movable. It will be evident that similar advantages as mentioned above can be obtained if the electrodes 4 are movable and the electrodes 7 are fixed; in that case the first supporting plate 2 has a fixed transparent electrode 18 whilst the electrode 6 may or may not be dispensed with, dependent on the drive mode.

What is claimed is:

1. A display device comprising (a) first and second separated, radiation-transparent supporting plates, (b) a plurality of display elements disposed between said supporting plates, each of said display elements including at least one fixed electrode and at least one movable electrode, said movable electrode being movable relative to said fixed electrode by electrostatic forces, and said movable electrode having two end positions determined by abutment faces, said fixed electrodes and movable electrodes defining a pattern of radiation-transparent apertures, (c) an electrically insulating layer disposed between said fixed electrodes and said movable electrodes, (d) a pattern of areas being non-transparent to radiation and being disposed on said fixed electrodes, said pattern of areas being substantially identical in size to said pattern of radiation-transparent apertures, wherein coplanar disposition of said pattern of radiation-transparent apertures and said pattern of areas substantially prevents passage of radiation by said fixed and said movable electrodes, (e) luminescent material disposed on one of said first and second radiation-transparent supporting plates at a viewing side, said luminescent material being disposed between said first and second radiation-transparent supporting plates adjacent to and facing said electrodes, (f) radiation source means at a side opposite to said viewing side for emitting radiation of a sufficiently short wavelength to excite said luminescent material, and (g) reflective surfaces disposed on at least one of said fixed electrodes or said movable electrodes at sides facing said luminescent material to reflect radiation emitted by said luminescent material in a direction to increase passage of radiation through said viewing side.

2. A display device according to claim 1, wherein both said fixed electrodes and said movable electrodes have said reflective surfaces to reflect said radiation emitted by said luminescent material.

3. A display device according to claim 1, wherein said fixed electrodes or said movable electrodes disposed closest to said luminescent material have said reflective surfaces on a side remote from said luminescent material.

4. A display device according to claim 1 or claim 2 or claim 3, wherein said radiation source means emits radiation at a central wavelength of 254 nm, and wherein said luminescent material includes at least one of a blue phosphor of $BaMg_2Al_{16}O_{27}$:Eu [as a blue phosphor], a green phosphor of $CeMgAl_{11}O_{19}$:Tb [as a green phosphor], and a red phosphor of $Y_2O_3$:Eu [as a red phosphor].

5. A display device according to claim 1 or claim 2 or claim 3, wherein said radiation source means emits radiation at a wavelength ranging from 360 to 380 nm.

6. A display device according to claim 1 or claim 2 or claim 3, wherein a transparent counter electrode is disposed between said luminescent material and said one of said first and second radiation-transparent supporting plates.

7. A display device according to claim 1 or claim 2 or claim 3, wherein said radiation source means is a diffuse radiation source.

8. A display device according to claim 7, wherein said radiation source means emits radiation at a central wavelength of 254 nm, and wherein said luminescent material includes at least one of a blue phosphor of $BaMg_2Al_{16}O_{27}$:Eu [as a blue phosphor], a green phosphor of $CeMgAl_{11}O_{19}$:Tb [as a green phosphor], and a red phosphor of $Y_2O_3$:Eu [as a red phosphor].

9. A display device according to claim 7, wherein said radiation source means emits radiation at a wavelength ranging from 360 to 380 nm.

* * * * *